US006372115B1

(12) United States Patent
Miyasaka et al.

(10) Patent No.: US 6,372,115 B1
(45) Date of Patent: Apr. 16, 2002

(54) PROCESS FOR ANODIZING SI-BASED ALUMINUM ALLOY

(75) Inventors: Hajime Miyasaka; Haruaki Matsukawa, both of Sayama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/574,610

(22) Filed: May 11, 2000

(30) Foreign Application Priority Data

May 11, 1999 (JP) ..... 11-130551

(51) Int. Cl.[7] ..... C25D 11/18; C25D 5/50; C25D 9/06

(52) U.S. Cl. ..... 205/204; 205/201; 205/203; 205/220; 205/224; 205/229

(58) Field of Search ..... 205/201, 203, 205/204, 220, 224, 229

(56) References Cited

U.S. PATENT DOCUMENTS 5,104,743 A * 4/1992 Nishikawa et la. ..... 428/472.2
5,775,892 A * 7/1998 Miyasaka et al. ..... 418/55.2
6,010,816 A * 1/2000 Nishio et al. ..... 430/165

* cited by examiner

*Primary Examiner*—Edna Wong
*Assistant Examiner*—Thao Tran
(74) *Attorney, Agent, or Firm*—Merchant & Gould, P.C.

(57) ABSTRACT

A process for anodizing an Si-based aluminum alloy comprises the steps of subjecting the Si-based aluminum alloy to electrolysis in an electrolyte containing phosphate and fluoride to form an anodized film on the aluminum alloy, infiltrating a photosetting or thermosetting resin in liquid form into microholes in the anodized film, and radiating light or heat at the infiltrated resin to make the resin become hardened. Phosphate makes diameters of the microholes large while fluoride dissolves Si moderately and facilitates growth of the film. As a result, a large amount of the photosetting or thermosetting resin can be infiltrated into the microholes of the film, thereby making a surface of the film flat.

7 Claims, 6 Drawing Sheets

PROCESS FOR ANODIZING SI-BASED ALUMINUM ALLOY

BACKGROUND OF THE INVENTION

1. Field of the Invention

This invention relates to an improvement in a process for anodizing an Si-based aluminum alloy to form an anodized film on a surface of the alloy.

2. Description of the Prior Art

In recent years, pistons of Si- or silicon-based aluminum alloy have been widely used in internal combustion engines because they are light in weight and hence can make reciprocal movements at a high speed.

A typical example of such pistons is schematically shown in FIG. 5 hereof. As illustrated therein, a piston 100 is disposed within a cylinder 101 such that it can make reciprocal movements at a high speed between top and bottom dead centers 102, 103 along an inner peripheral surface 104 of the cylinder 101. The piston 100 includes piston rings 100*b* which act to normally keep the piston 100 out of contact with the cylinder 101. However, the piston 100 occasionally inclines for certain reasons. When the piston 100 inclines more than a given amount, a skirt 100*a* of the piston 100 is brought into contact with the cylinder 101 to thereby prevent further inclination of the piston 100. Consequently, it becomes necessary for the piston 100, particularly the skirt 100*a*, to have excellent wear resistance.

An example of pistons which are light in weight and have excellent wear resistance may be one cast from an Si-based aluminum alloy with an anodized film formed on a surface thereof. Discussion will be made next as to a process for anodizing a surface of such a piston of Si-based aluminum alloy.

The anodization process comprises the steps of immersing the Si-based aluminum alloy piston into an electrolyte to make the piston act as an anode, charging the electrolyte with a direct current to electrolyze water therein to thereby generate oxygen, and causing the generated oxygen to react with aluminum to thereby form a film of $Al_2O_3$ on a surface of the Si-based aluminum alloy piston. The film of $Al_2O_3$ is passive and generally called an anodized film having good corrosion and wear resistance.

When a surface of the skirt that may be held in contact with the cylinder is rough, there is a fear that undesired scoring and burning will occur during movement of the piston. To prevent this burning, a certain proposed piston has an anodized film with a resin infiltrated into the film to reduce its friction resistance.

Discussion will be made next as to an anodized film with a resin infiltrated thereinto, with reference to FIGS. 6A to 6C showing a conventional piston of Si-based aluminum alloy.

An anodized film shown as an example in FIG. 6A is formed by using a sulfuric acid electrolyte. An aluminum alloy piston 100 as a base material includes Si particles 111 distributed therein. Si particles 112 located closely to a surface of the piston 100 adversely affect an anodized film 113, thereby making the anodized film uneven or rough.

In that part of the piston where an Si particle 115 is partially exposed to outside accidentally as shown in FIG. 6B, there is formed no anodized film but a large hollow D1. In that part of the piston where an Si particle 116 is positioned closely to a piston surface, there is formed an anodized film 117 but the film thickness is small compared to the surrounding film 113. In addition, a hollow D2 is formed above the film 117.

Consequently, it has been found that an even or flat anodized film can not be obtained by anodizing the aluminum alloy piston in a sulfuric acid electrolyte. It has also been found that microholes 118 resulted from a sulfuric acid electrolyte generally have a small hole diameter d1 of the order of 15 nm. In FIG. 6C, the microholes 118 are shown with a photosetting resin 119 in the form of a liquid, infiltrated thereinto and then photoset by applying a light thereto. Inherently, resins have small friction resistance. Thus, with the photoset resin 119 infiltrated into the anodized film portions 113, 117, it becomes possible to reduce friction resistance arising upon high-speed reciprocal movement of the aluminum alloy piston within the cylinder.

However, difficulty is experienced in making the anodized film 113 flat due to the hollows D1, D2 formed in the film 113 as shown in FIG. 6B. In addition, since the microholes 118 produced in the anodized film 113 have small hole diameters d1, it is difficult to make the film 113 contain the resin sufficiently. This leads to the fear that notwithstanding the resin 119 infiltrated into the anodized film 113, the friction resistance of the film will not be made as small as desired.

SUMMARY OF THE INVENTION

It is therefore an object of the present invention to provide an improved process for anodizing an Si-based aluminum alloy, which enables sufficient reduction of the friction resistance of an anodized film to be formed on the alloy.

According to an aspect of the present invention, there is provided a process for anodizing an Si-based aluminum alloy, which process comprises the steps of; subjecting the Si-based aluminum alloy to electrolysis in an electrolyte containing phosphate and fluoride to form an anodized film on the alloy; infiltrating a photosetting or thermosetting resin in liquid form into microholes in the anodized film; and radiating light or heat at the infiltrated resin to make the resin become hardened.

Phosphate causes the microholes to have large hole diameters while fluoride dissolves Si moderately and facilitates growth of the film. As a result, a large amount of the photosetting or thermosetting resin can be infiltrated into the microholes of the film, thereby making a surface of the film flat and thus reducing friction resistance of the film.

In a preferred form, the resin contains fluoride. Since fluoride has good wear- and heat-resisting properties, inclusion of fluoride makes the alloy best suited for application to pistons, which are exposed to a high temperature.

BRIEF DESCRIPTION OF THE DRAWINGS

A preferred embodiment of the present invention will now be described in detail, by way of example only, with reference to the accompanying drawings, in which.

DETAILED DESCRIPTION OF THE PREFERRED EMBODIMENT

The following description is merely exemplary in nature and is in no way intended to limit the invention, its application or uses.

Figure 1:
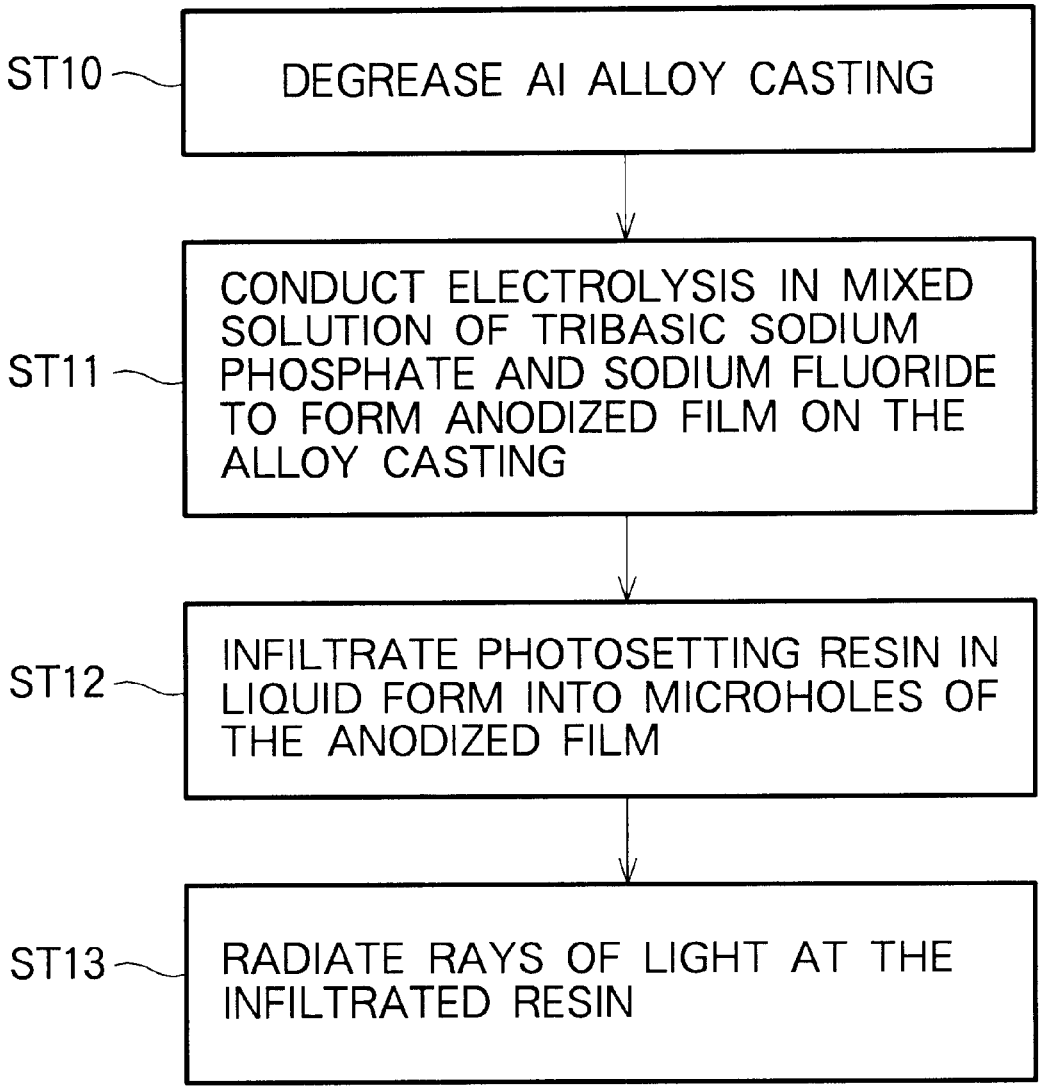
FIG. 1 is a flowchart illustrating a process for anodizing an Si-based aluminum alloy piston in accordance with the present invention.

Initial reference is made to the flowchart of FIG. 1 wherein the term STEP is shown in its abbreviated form "ST".

At ST 10, a piston formed from an AC 8C aluminum alloy, selected as an Si-based aluminum alloy, hereinafter simply called "aluminum alloy pistons", is subjected to degreasing for removal of grease from a surface thereof.

Then, at ST 11, electrolysis is conducted in an aqueous solution containing tribasic sodium phosphate and sodium fluoride with the aluminum alloy piston immersed thereinto, to form an anodized film on a surface of the piston. At this time, microholes are formed in the anodized film.

Continuously, at ST 12, photosetting resin in the form of a liquid containing fluorocarbon polymers is provided, following which the photosetting resin is caused to infiltrate into the microholes in the anodized film.

Thereafter, at ST 13, the photosetting resin is applied with light so that it becomes photoset. This completes the inventive Si-based aluminum alloy anodizing process.

Discussion will be made next as to how the aluminum alloy piston becomes after treatments under ST 10 to ST 13, with reference to FIGS. 2A and 2B and FIGS. 3A and 3B.

Figure 2A:
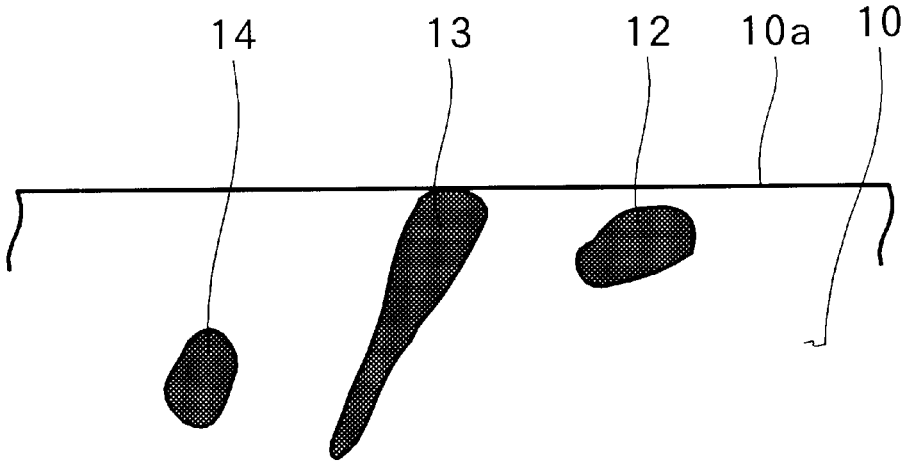
FIGS. 2A and 2B are schematic views illustrating the conditions of the aluminum alloy piston after a first half of the process according to the present invention.

FIG. 2A illustrates the surface 10*a* of the piston 10, which has been degreased at ST 10. Aluminum alloy piston 10 includes Si particles 12, 13, 14 dispersed from right to left in the aluminum.

Figure 2B:
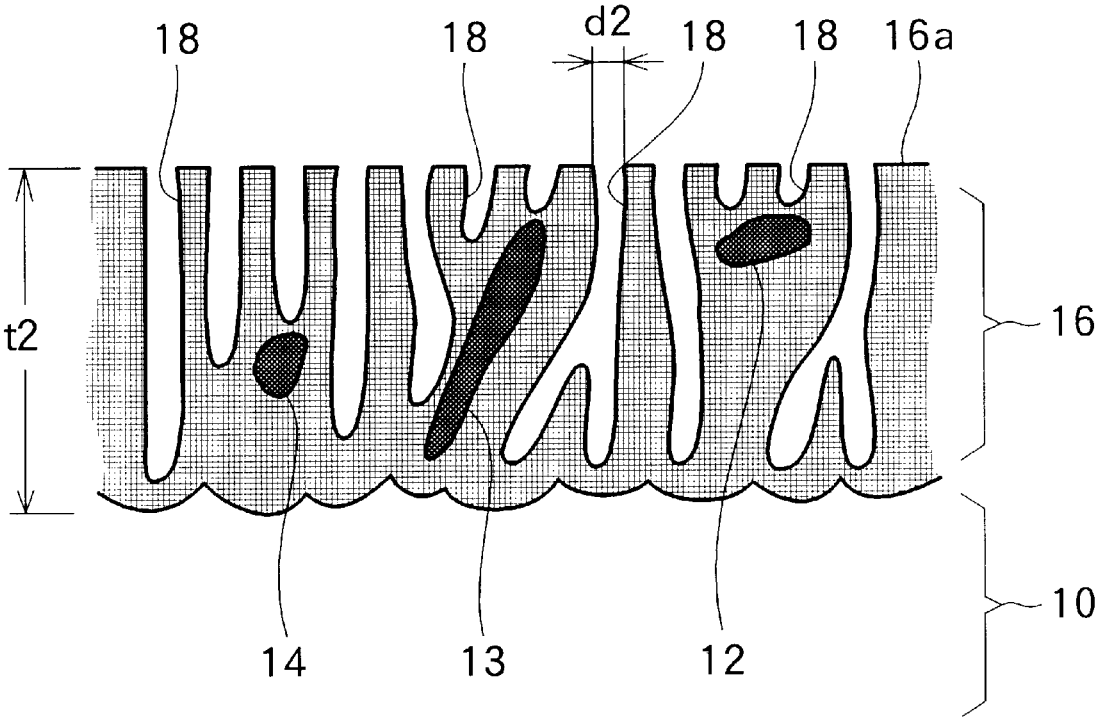

FIG. 2B illustrates the piston surface 10*a* after anodization at ST 11. As a result of electrolysis in an aqueous solution containing tribasic sodium phosphate and sodium fluoride, an anodized film 16 is formed on the piston 10. By the corrosion action of the tribasic sodium phosphate, the surface 10*a* dissolves to thereby cause the Si particles 12, 13, 14 to be exposed to outside. By the action of the sodium fluoride, those Si particles 12, 13, 14 dissolve and become small.

Consequently, notwithstanding the presence of the Si particles 12, 13, 14, the anodized film 16 grows smoothly. As a result, a surface 16*a* of the anodized film 16 becomes even, whereby its surface roughness is kept to a minimum and film thickness t2 becomes substantially uniform. In addition, by virtue of the action of the tribasic sodium phosphate contained in the electrolyte, the hole diameters d2 of the microholes 18 are made large enough for the purpose to be described below.

Figure 3A:
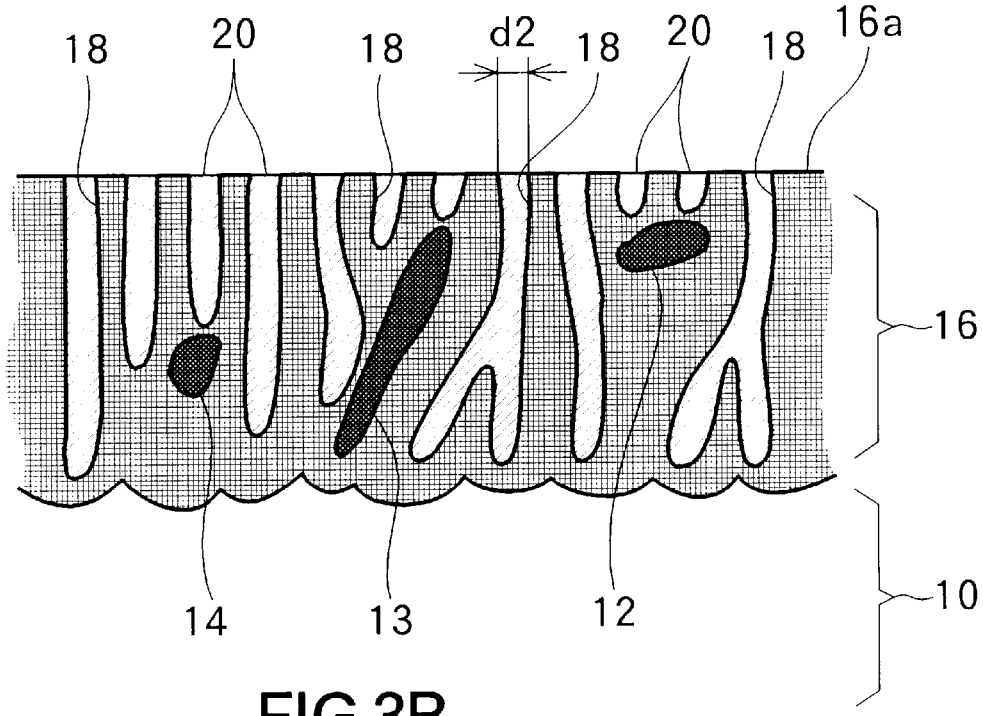
FIGS. 3A and 3B are schematic views illustrating the conditions of the aluminum alloy piston after a second half of the process according to the present invention.

FIG. 3A illustrates the piston 10 with anodized film 16 after ST 12 (resin infiltration). That is, a photosetting resin 20 in the form of a liquid containing fluorocarbon polymers is infiltrated into microholes 18 of the anodized film 16. Each microhole 18 has a large hole diameter of the order of 100 nm so that a large amount of the photosetting resin 20 can be infiltrated into the microholes 18. The photosetting resin 20 may be one that inherently takes the form of a liquid without going through solvent dilution.

Figure 3B:
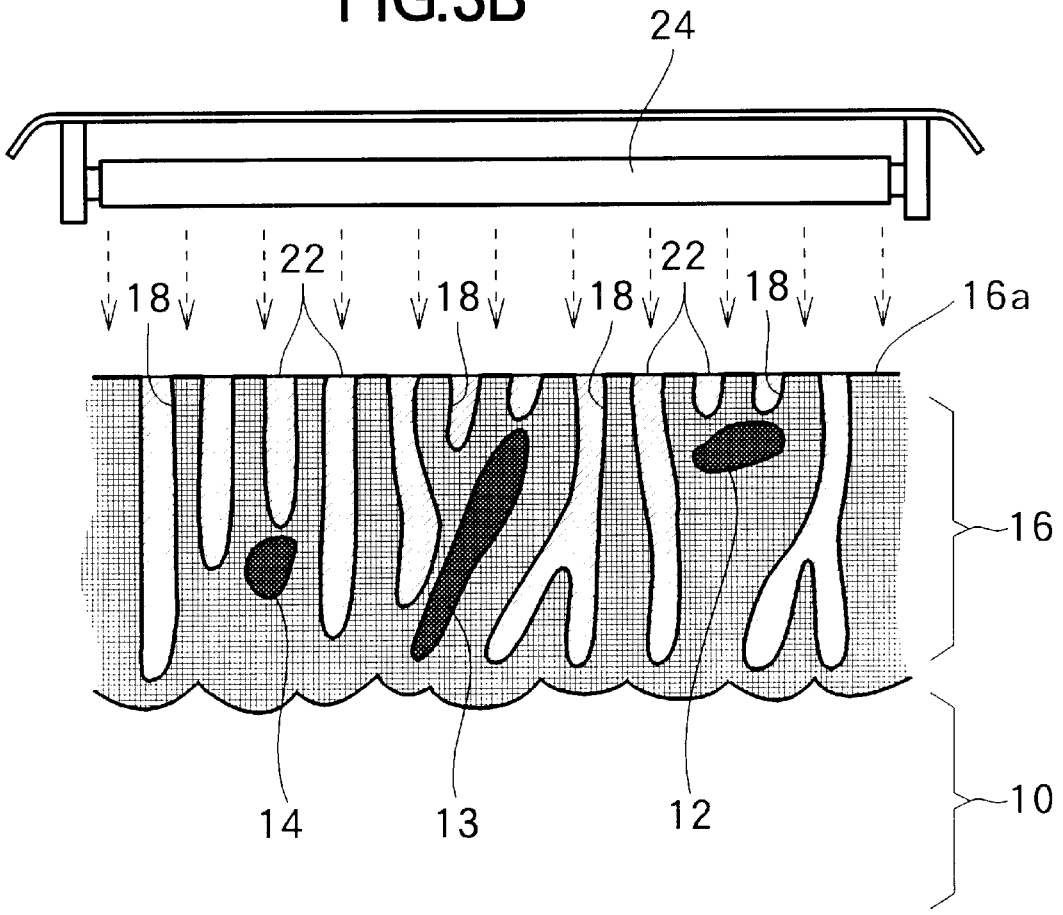

FIG. 3B illustrates the piston 10 with the anodized film 16 going through the treatment of ST 13 (resin photosetting). Rays of light are applied from an irradiation lamp 24 to the photosetting resin 20 infiltrated into the microholes 18, as shown by arrows, to thereby photoset the resin 20. This completes the inventive anodization process for the aluminum alloy piston 10. The photoset resin will hereinafter be designated by reference numeral 22.

Tribasic sodium phosphate has a function to make a hole diameter large while sodium fluoride has a function to dissolve Si and to aid in the film growth. Thus, with the tribasic sodium phosphate contained in the electrolyte, it becomes possible to make the hole diameters d2 of the microholes 18. With the hole diameters made large, a large amount of the photoset resin 22 can be infiltrated into the microholes 18 of the anodized film 16 and fixedly secured therein.

In addition, with the sodium fluoride contained in the electrolyte, it becomes possible to moderately dissolve Si and to assist in the film growth to thereby make the surface 16*a* of the resulting anodized film 16 even or smooth. With the film surface 16*a* made even, the friction resistance of the anodized film surface 6*a* can be significantly reduced.

Moreover, since the fluorocarbon polymers contained in the photoset resin 22 have excellent wear- and heat-proof properties, they make the photoset resin 22 wear- and heat-proof. This enables use of the photoset resin 22 at a high temperature, e.g., 100° C. to 300° C., and hence application of the resin to a piston exposed to a high temperature.

Discussion will be made next as to an implementation according to this invention, in comparison with a comparative example, with reference to Tables 1 and 2 and FIG. 4.

In both the implementation and comparative example, an AC8C (#H5202 "aluminum alloy casting" according to JIS) containing a 10% of Si was used, the components of which are as given in Table 1 below.

TABLE 1

| JIS SYMBOLS | Cu | Si | Mg | Zn | Fe | Mn | Ni | Ti | Pb | Sn | Cr | Al |
|---|---|---|---|---|---|---|---|---|---|---|---|---|
| AC8C | 2.0 to 4.0 | 8.5 to 10.5 | 0.50 to 1.5 | less than 0.50 | Less than 1.0 | less than 0.50 | less than 0.50 | less than 0.20 | less than 0.10 | less than 0.10 | less than 0.10 | balance |

The conditions and results of the implementation and comparative example are as indicated in Table 2 below:

TABLE 2

| | | IMPLEMENTATION | COMPARATIVE EXAMPLE |
|---|---|---|---|
| | aluminum alloy | AC8C | AC8C |
| anodization | Electrolyte | mixed solution of 0.4 mol of tribasic sodium phosphate and 0.125 mol of sodium fluoride | 15% sulfuric acid |
| | temperature of electrolyte | 22° C. | 0° C. |
| | Voltage | 70 V | 5 V |
| | operation time | 30 minutes | 20 minutes |
| results | hole diameter | 100 nm | 15 nm |
| | surface roughness | 2–3 μm | 12–13 μm |
| resin infiltration | reduced pressure | 10 Torr | 10 Torr |
| | immersion liquid | perfluorooctylethyl methacrylate | perfluorooctyl-ethyl methacrylate |
| | immersion time | 5 minutes | 5 minutes |
| | setting time | 5 minutes | 5 minutes |
| results | coefficient of friction μ | 0.006 at surface pressure of 30 kgf/cm$^2$ | 0.07 at surface pressure of 30 kgf/cm$^2$ |

Implementation

After degreasing of its surface, the aluminum alloy piston was subjected to electrolysis conducted in a mixed electrolyte of 0.4 mol/l of tribasic sodium phosphate and 0.125 mol/l of sodium fluoride at 22° C. and 70V and lasted for 30 minutes to thereby form an anodized film on the piston surface.

Microholes of the anodized film have a hole diameter d2 (see FIG. 2A) as large as 100 nm. Maximum surface roughness Rmax of the anodized film is 2–3 m, whereby the film surface becomes substantially flat. The term "Rmax" used herein is defined under B 0601 of JIS as representing a maximum height of surface roughness.

Next, the anodized film thus formed was immersed in a liquid of perfluorooctylethyl methacrylate (photosetting resin), held at a reduced pressure of 10 mmHg, for 5 minutes. After release from the reduced pressure condition, the anodized film was then immersed in a bath of hot water of 98° C. for 10 minutes. Continuously, after it was pulled out of the hot water, the film was applied with rays of light by means of the irradiation lamp for 5 minutes to harden the photosetting resin infiltrated thereinto.

This provided a coefficient of friction μ as small as 0. 003 at a surface pressure of 30 kgf/cm$^2$. The coefficient of friction μ will be described in detail in relation to the graph of FIG. 4.

Graphic formula of perfluorooctylethyl methacrylate is as given below;

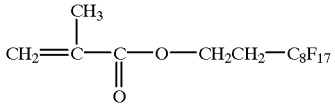

COMPARATIVE EXAMPLE

After degreasing of its surface, the aluminum alloy piston was subjected to electrolysis conducted in an electrolyte containing 15% sulfuric acid at 0° C. and 15 V and lasted for 20 minutes to thereby form an anodized film on the piston surface.

Figure 6A:
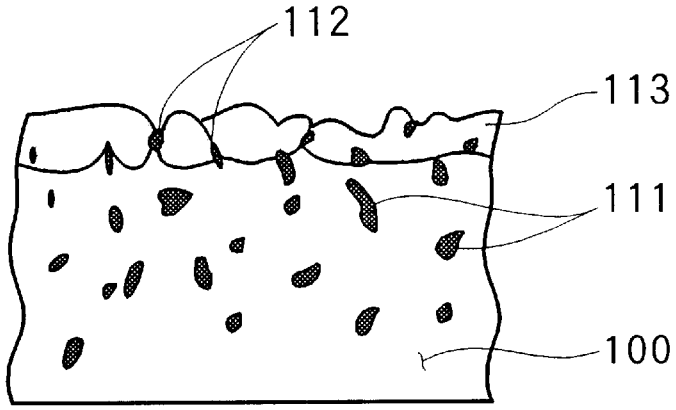
FIG.6A (Prior Art)
FIGS. 6A to 6C are schematic views illustrating on an enlarged scale an anodized film of the conventional Si-based aluminum alloy piston.
Figure 6B:
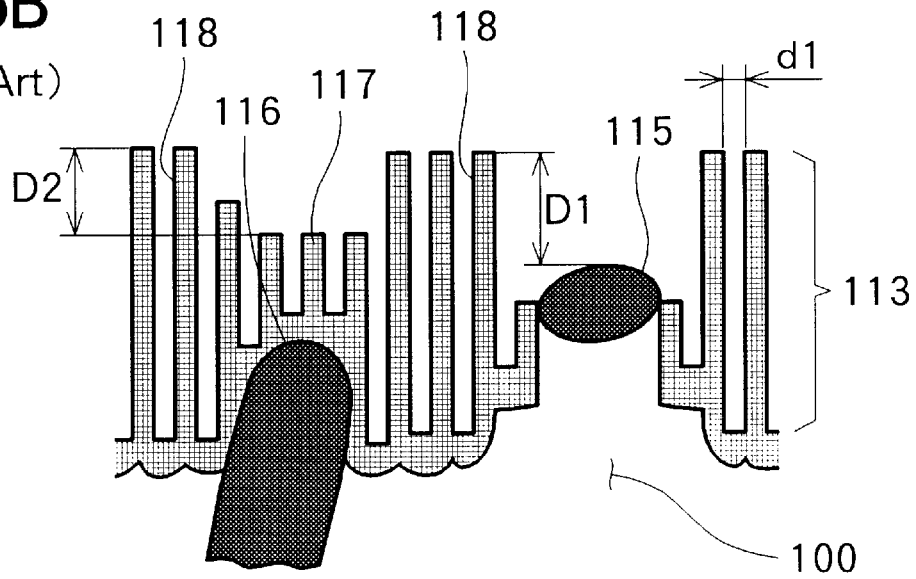
FIG.6B (Prior Art)
Figure 6C:
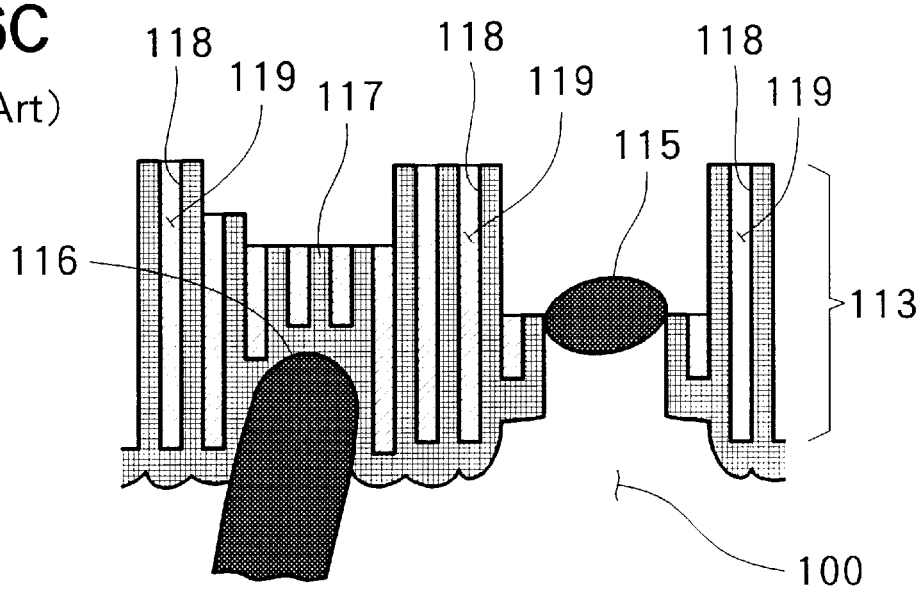
FIG.6C (Prior Art)

Hole diameter d1 (see FIG. 6B) of the microholes of the formed anodized film is as small as 15 nm. Maximum surface roughness Rmax of the formed anodized film is as large as 12 to 13 m, thereby rendering the film surface rough.

Next, the anodized film thus formed was immersed in a liquid of perfluorooctylethyl methacrylate (photosetting resin), held at a reduced pressure of 10 mmHg, for 5 minutes. After release from the reduced pressure condition, the anodized film was then immersed in a bath of hot water of 98° C. for 10 minutes. Continuously, after it was pulled out of the hot water, the film was applied with rays of light by means of the irradiation lamp for 5 minutes to harden the photosetting resin infiltrated thereinto.

This provided a coefficient of friction μ as large as 0.07 at a surface pressure of 30 kgf/cm$^2$. The coefficient of friction μ will be described in detail in relation to the graph of FIG. 4.

Figure 4:
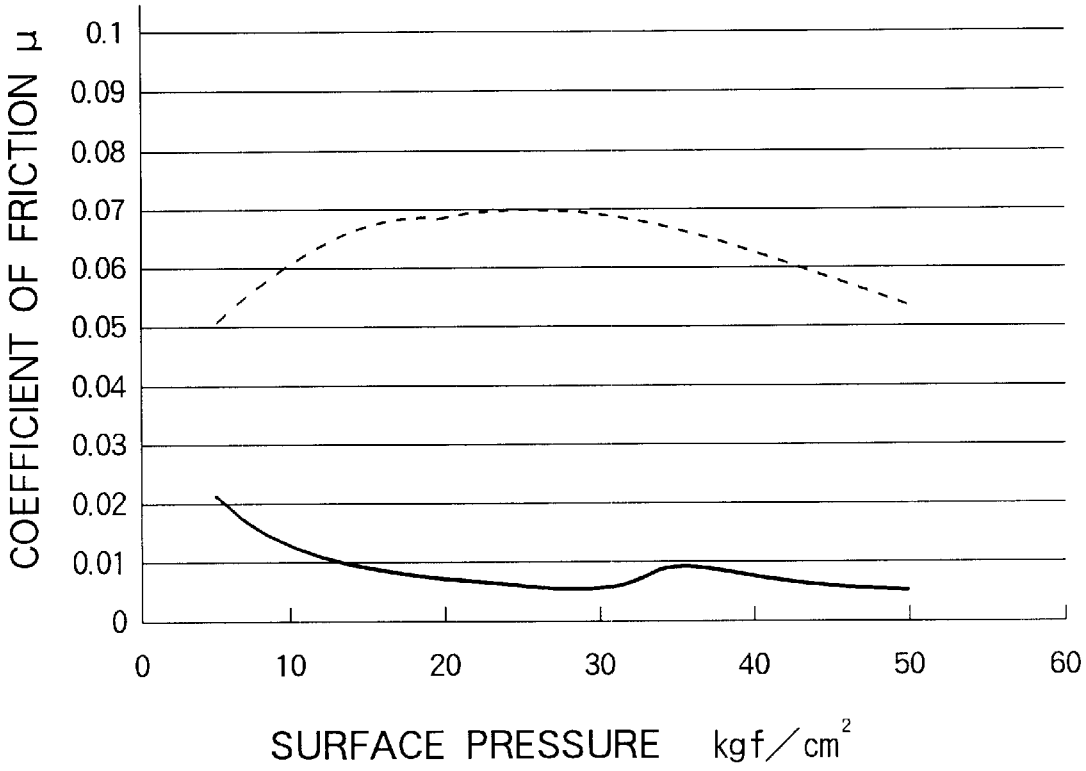
FIG. 4 is a graph showing a coefficient of friction of an anodized film resulted from the anodization process in accordance with the present invention.
Figure 5:
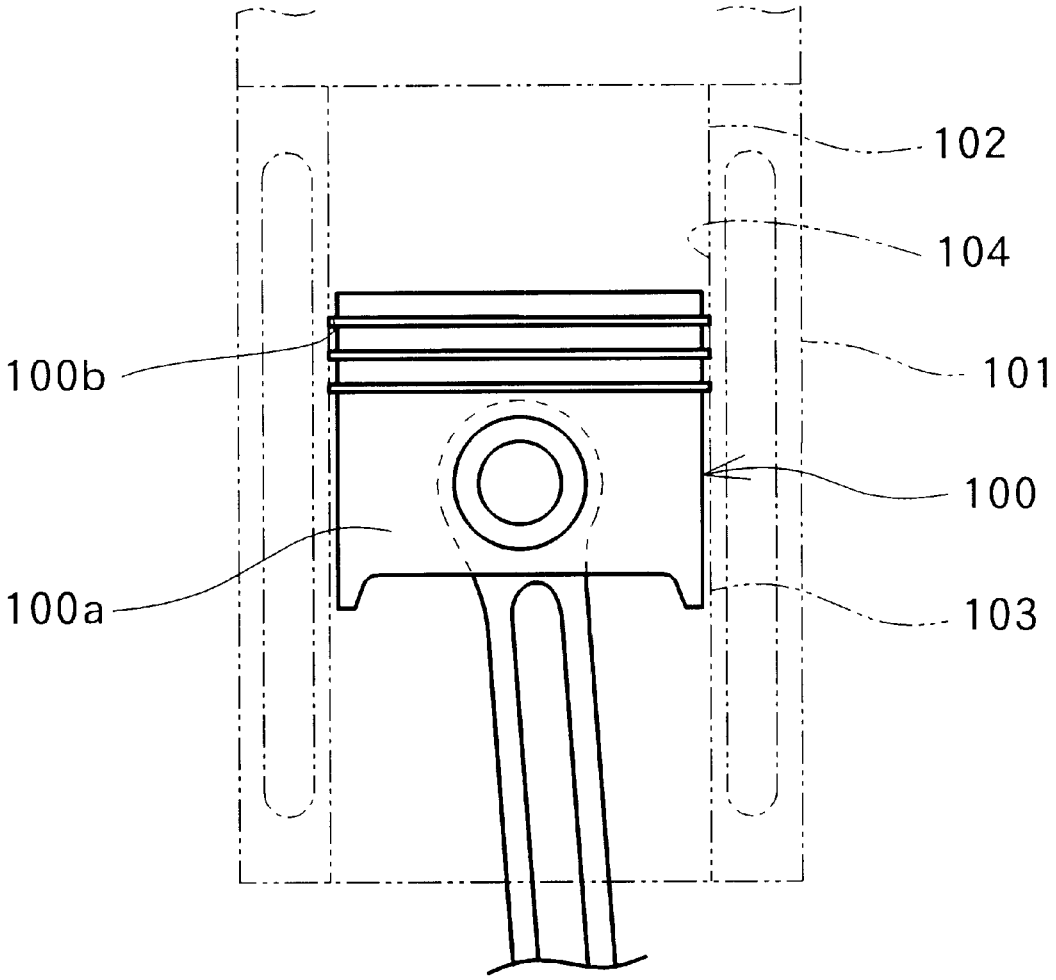
FIG.5 (Prior Art)
FIG. 5 is a side elevational view showing a conventional piston of Si-based aluminum alloy.

Reference is now made to the graph of FIG. 4, wherein coefficients of friction μ are shown along a vertical axis while surface pressures kgf/cm$^2$ are shown along a horizontal axis.

As shown by a solid line, the anodized film according to the implementation has coefficients of friction μ of about 0.013 at a surface pressure of 10 kgf/cm$^2$, 0.008 at a surface pressure of 20 kgf/cm$^2$, 0.006 at a surface pressure of 30 kgf/cm$^2$, 0.008 at a surface pressure of 40 kgf/cm$^2$, and 0.006 at a surface pressure of 50 kgf/cm$^2$. Thus, the coefficients of friction μ of the implementation are reduced to as small as 0.013 or lower throughout a pressure range of 10–50 kgf/cm$^2$.

In contrast, the anodized film of the comparative example has coefficients of friction μ of about 0.06 at a surface pressure of 10 kgf/cm$^2$, 0.069 at a surface pressure of 20 kgf/cm$^2$, 0.069 at a surface pressure of 30 kgf/cm$^2$, 0.062 at a surface pressure of 40 kgf/cm$^2$, and 0.054 at a surface pressure of 50 kgf/cm$^2$. Thus, the coefficients of friction μof the comparative example in a range of surface pressure of 10–50 kgf/cm$^2$ are far larger than 0.013, the largest coefficient of friction μ of the implementation.

Although the present invention has been described thus far as applied to a piston of Si-based aluminum alloy, the invention may also be applied to other Si-based aluminum alloy castings, as well as to non-cast members.

Again, although the preferred embodiment of the present invention exemplified use of tribasic sodium phosphate, sodium phosphate may also be used.

In place of sodium fluoride as used in the preferred embodiment, potassium fluoride may also be used in that an alkaline-metal-based fluoride can produce equivalent results.

Although the preferred embodiment exemplified use of perfluorooctylethyl methacrylate in liquid form as a photosetting resin, other photosetting resins containing fluorine may also be used in its place. These other photosetting resins include resins which become hardened by ultraviolet rays and visible radiation.

In place of a photosetting resin as used in the preferred embodiment, a thermosetting resin may also be used because it can produce equivalent results.

Obviously, various minor changes and modifications of the present invention are possible in the light of the above teaching. It is therefore to be understood that within the scope of the appended claims, the invention may be practiced otherwise than as specifically described.

What is claimed is:

1. A process for anodizing an Si-based aluminum alloy, comprising the steps of:

subjecting the Si-based aluminum alloy to electrolysis in an electrolyte containing tribasic sodium phosphate and fluoride to form an anodized film having surface roughness of 2–3 $\mu$m on the alloy;

infiltrating a photosetting or thermosetting resin in liquid form into microholes in said anodized film, said resin being a fluorocarbon polymer; and radiating light or heat at the infiltrated resin to make the resin become hardened.

2. A process for anodizing an Si-based aluminum alloy according to claim 1 wherein the anodized film from said process has a coefficient of friction less than 0.02 at a surface pressure of 10 kgf/cm$^2$.

3. A process for anodizing an Si-based aluminum alloy according to claim 1 wherein the microholes have a hole diameter greater than 15 nm and less than about 100 nm.

4. A process for anodizing an Si-based aluminum alloy according to claim 1 wherein the photosetting or thermosetting resin is infiltrated into the microholes at a reduced pressure.

5. A process for anodizing an Si-based aluminum alloy according to claim 1 wherein the fluorocarbon polymer is a perfluoroalkyl methacrylate.

6. A process for anodizing an Si-based aluminum alloy according to claim 1 wherein the fluorocarbon polymer is perfluorooctylethyl methacrylate.

7. A process for anodizing an Si-based aluminum alloy according to claim 1 wherein the aluminum alloy comprises 8.5% to 10.5% silicon.

* * * * *